US008870041B2

(12) United States Patent
Kuroda et al.

(10) Patent No.: US 8,870,041 B2
(45) Date of Patent: Oct. 28, 2014

(54) IMMERSION NOZZLE FOR CONTINUOUS CASTING

(75) Inventors: Takahiro Kuroda, Kitakyushu (JP); Jouji Kurisu, Kitakyushu (JP); Hiroki Furukawa, Kitakyushu (JP); Arito Mizobe, Kitakyushu (JP)

(73) Assignee: Krosaki Harima Corporation, Kitakyushu-shi (JP)

( * ) Notice: Subject to any disclaimer, the term of this patent is extended or adjusted under 35 U.S.C. 154(b) by 295 days.

(21) Appl. No.: 13/416,848

(22) Filed: Mar. 9, 2012

(65) Prior Publication Data

US 2012/0248157 A1 Oct. 4, 2012

(30) Foreign Application Priority Data

Mar. 31, 2011 (JP) ..... 2011-079668

(51) Int. Cl.
*B22D 41/50* (2006.01)

(52) U.S. Cl.
CPC ..... *B22D 41/50* (2013.01)
USPC ..... 222/591

(58) Field of Classification Search
CPC ..... B22D 41/50; B22D 41/56; B22D 41/00
USPC ..... 222/591, 594, 606, 607; 266/236; 164/437, 337, 488
See application file for complete search history.

(56) References Cited

U.S. PATENT DOCUMENTS 4,949,778 A * 8/1990 Saito et al. ..... 164/468
6,860,318 B2 * 3/2005 Tahitu et al. ..... 164/488
8,037,924 B2 10/2011 Kido et al.
8,113,391 B2 2/2012 Otsuka et al.
2007/0102852 A1 * 5/2007 Richaud et al. ..... 266/236
2007/0158884 A1 7/2007 Tsukaguchi
2009/0242592 A1 * 10/2009 Otsuka et al. ..... 222/591

FOREIGN PATENT DOCUMENTS

DE 43 19 194 A1 12/1994
JP 57-106456 7/1982
JP 4-238658 8/1992

(Continued)

OTHER PUBLICATIONS

Office Action issued Jan. 24, 2011 in co-pending U.S. Appl. No. 12/400,358.

(Continued)

*Primary Examiner* — Scott Kastler
*Assistant Examiner* — Michael Aboagye
(74) *Attorney, Agent, or Firm* — Oblon, Spivak, McClelland, Maier & Neustadt, L.L.P.

(57) ABSTRACT

The immersion nozzle for continuous casting, including a tubular body with a bottom, a pair of first outlets, and a pair of second outlets, wherein at least a lower section of the tubular body has a rectangular flat cross section; the two opposing first outlets are disposed in narrow sidewalls at the lower section; the pair of second outlets is disposed at the bottom; each of the first outlets is partitioned by a partitioning section formed at the first outlet into an upper outlet and a lower outlet; ridges formed between the partitioning sections respectively project into a passage from a wide inner wall of the passage; the pair of second outlets is disposed symmetrically to a central axis of the tubular body such that virtual faces extended from tilted faces of the second outlets intersect with each other in the passage.

10 Claims, 13 Drawing Sheets

(56) References Cited

FOREIGN PATENT DOCUMENTS

| | | |
|---|---|---|
| JP | 7-232247 | 9/1995 |
| JP | 8-294757 | 11/1996 |
| JP | 2001-347348 | 12/2001 |
| JP | 2009-233717 | 10/2009 |
| WO | WO 98/14292 | 4/1998 |
| WO | WO 2005/049249 A2 | 6/2005 |

OTHER PUBLICATIONS

Chinese Office Action issued on Dec. 24, 2010 in corresponding Chinese Application No. 200910129821.4 (with an English Translation).

* cited by examiner

IMMERSION NOZZLE FOR CONTINUOUS CASTING

CROSS REFERENCE TO RELATED APPLICATION

This application is based upon and claims benefit of priority of Japanese Patent Application No. 2011-079668 filed on Mar. 31, 2011, the contents of which are incorporated herein by reference.

BACKGROUND OF THE INVENTION

1. Field of the Invention

The present invention relates to a continuous casting immersion nozzle for pouring molten steel from a tundish into a mold and particularly to an immersion nozzle used for high-speed casting of thin to medium thick slabs.

2. Description of the Related Art

In continuous casting operation, appropriate control (e.g., prevention of drifts, suppression of level fluctuation in the mold, and the like) of a flow of molten steel in a mold is important to ensure and maintain quality of casting steel products as well as to carry out the operation safely and smoothly. Especially in high-speed casting of thin to medium thick slabs (about 50 mm to 150 mm in thickness), a width-thickness ratio (slab width/slab thickness) thereof is greater than that of normal slabs, and therefore it is often difficult to adjust the flow of the molten steel in the mold appropriately.

To achieve appropriate control of a flow of molten steel in a mold, the present inventors developed (invented) a continuous casting immersion nozzle as disclosed in Japanese Unexamined Patent Application Publication No. 2009-233717, for example. The continuous casting immersion nozzle includes a tubular body having a passage, and at least at a lower section of the tubular body includes a flat cross section. The lower section includes two pairs of outlets, one is disposed in narrow sidewalls thereof and the other is disposed in a bottom thereof. And, provided between the outlets disposed in the narrow sidewalls are ridges projecting inward from wide inner walls of the passage. In this way, a maximum flow velocity of the molten steel flow that collides with the narrow sidewalls of the mold is reduced, and thus a velocity of a reverse flow can be reduced. As a result, drifts and level fluctuation of the molten steel flow in the mold can be reduced, improving slab quality and productivity.

To improve a flow (movement) of molten steel discharged into a mold, International Publication No. WO1998/014292 discloses a casting nozzle including an inlet disposed at an upper end of a tubular body, a pair of upper outlets and a pair of lower outlets disposed at a lower end of the tubular body, and a baffle for dividing the molten steel flow into an outer stream discharged through the upper outlets and a central stream discharged through the lower outlets.

SUMMARY OF THE INVENTION

The present invention relates to an immersion nozzle for continuous casting, including a tubular body with a bottom, a pair of first outlets, and a pair of second outlets. The tubular body has an inlet for entry of molten steel disposed at an upper end and a passage extending inside the tubular body downward from the inlet. At least a lower section of the tubular body has a rectangular flat cross section. The two opposing first outlets are disposed in narrow sidewalls at the lower section so as to communicate with the passage. The pair of second outlets is disposed at the bottom so as to communicate with the passage. The pair of first outlets are partitioned by a pair of partitioning sections formed at the first outlets, respectively. Each of the first outlets is partitioned into an upper outlet and a lower outlet. Provided between the pair of partitioning sections are ridges each projecting into the passage from a wide inner wall of the passage and horizontally intersecting the wide inner wall. The pair of second outlets is disposed symmetrically with respect to a central axis of the tubular body such that virtual faces extended from tilted faces of the second outlets intersect with each other in the passage.

The phrase "horizontally intersecting the wide inner wall" as used herein means that each of the ridges extends horizontally from one partitioning section to the other. The term "narrow sides" refers to the short sides of the tubular body having the rectangular flat cross section, and the term "wide sides" refers to the long sides of the tubular body. Throughout the present description, the directions are defined with the continuous casting immersion nozzle arranged upright.

According to the present invention, the ridges projecting inward from the wide inner walls diminish excessive flow velocities below the outlets. Also, the exit-stream from the upper outlets increases since each of the partitioning sections divides the first outlet in the narrow sidewall into the upper outlet and the lower outlet. As a result, a double-roll flowing pattern can be formed while suppressing collision of the exit-streams with mold wall faces and increase in the reverse flow due to the excessive flow velocities below the outlets. In addition, a drift in the mold is prevented because the flow of the molten steel in the passage is evenly distributed into the pair of first outlets by the ridges.

As shown in FIG. 13, the term "double-roll flowing pattern" refers to the flowing pattern of exit-streams 50, in which each of the exit-streams 50 is made up of (a) a main flow 51 flowing downward and (b) a narrow-side reverse flow 52 reversing and flowing up near a narrow side of the mold and then turning into a surface flow flowing from the narrow side of the mold toward the immersion nozzle. The narrow-side reverse flow 52 is carried toward the narrow side of the mold by the exit-stream 50 near the immersion nozzle, then reverses and flows up again to form a circulating flow.

DETAILED DESCRIPTION OF THE PREFERRED EMBODIMENTS

Figure 1A:
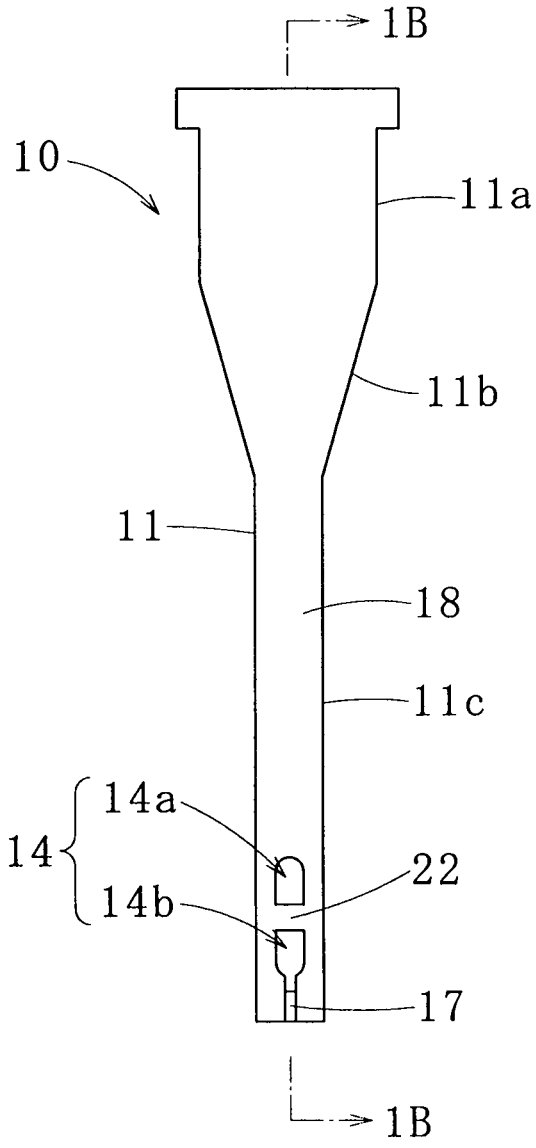
FIG. 1A is a side view of an immersion nozzle for continuous casting according to one embodiment of the present invention.
Figure 1B:
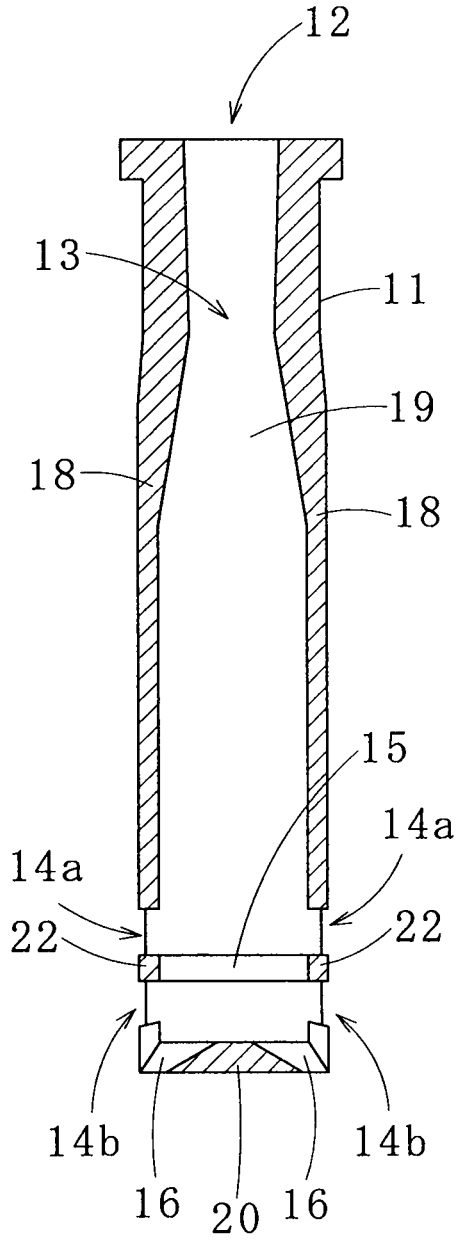
FIG. 1B is a cross-sectional view taken on line 1B-1B of FIG. 1A.

FIG. 1A and FIG. 1B show an immersion nozzle for continuous casting (hereafter, also referred to as "immersion nozzle") 10 according to one embodiment of the present invention. The immersion nozzle 10 according to the embodiment of the present invention mainly made of a tubular body 11 with a bottom 20. The tubular body 11 includes a cylindrical upper section 11*a* having an inlet 12 for entry of molten steel disposed at an upper end, a lower section 11*c* having a rectangular flat cross section, and a tapered section 11*b* tapered in a side view. The tapered section 11*b* connects the cylindrical upper section 11*a* and the lower section 11*c* having the rectangular flat cross section. In addition, a passage 13 is formed inside the tubular body 11, and the passage 13 extends downward from the inlet 12.

Figure 2A:
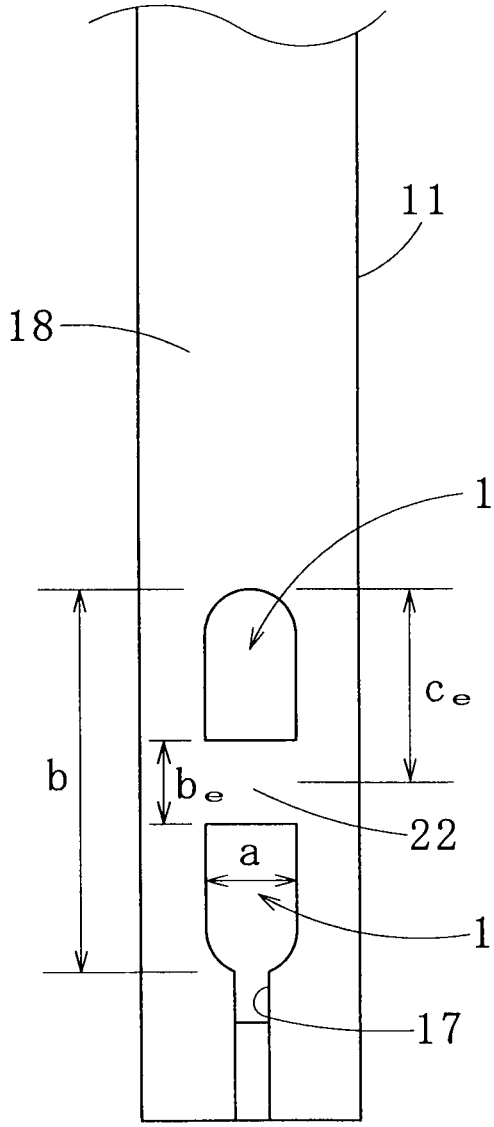
FIG. 2A is a partial side view of the immersion nozzle for the continuous casting.

In opposing narrow sidewalls 18 of the lower section 11*c* having the rectangular flat cross section, first outlets 14 communicating with the passage 13 are formed respectively at positions close to the bottom 20. Each of the first outlets 14 includes an elongated hole having semicircular upper and lower ends. The elongated hole is long in a vertical direction, and is divided into an upper outlet 14*a* and a lower outlet 14*b* by a partitioning section 22 having a rectangular cross section and extending in a horizontal direction (See FIG. 2A). Provided between the partitioning sections 22 forming a pair with each other are ridges 15 each projecting into the passage 13 from an opposing wide inner wall 19 of the passage 13 and horizontally intersecting the wide inner wall 19. The ridges 15 have rectangular cross sections and are disposed to face each other (See FIG. 2B).

Figure 3:
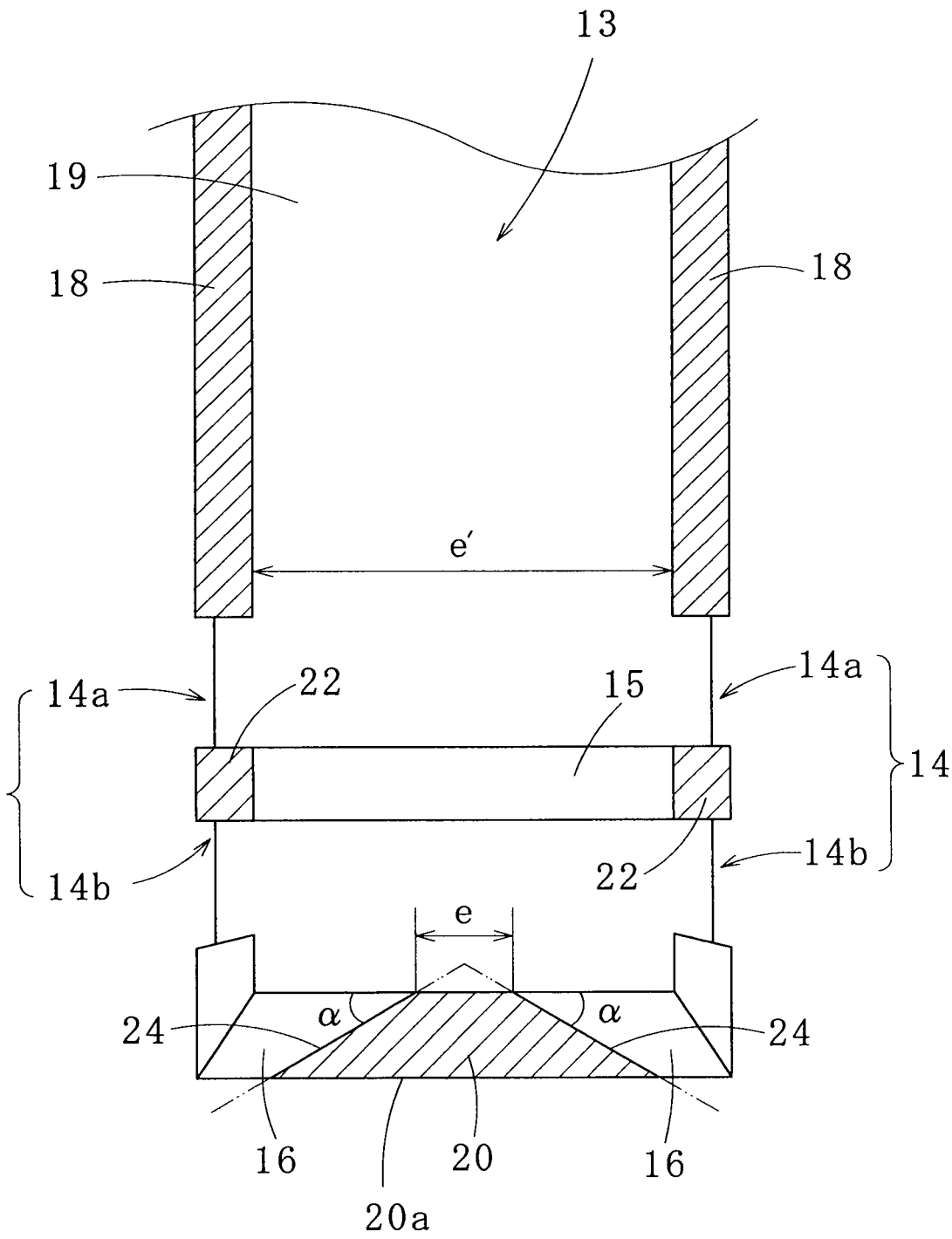
FIG. 3 is a partial vertical sectional view taken in a direction of wide sides of the immersion nozzle for the continuous casting.

The bottom 20 of the tubular body 11 includes a pair of second outlets 16 communicating with the passage 13. The pair of second outlets 16 is disposed symmetrically with respect to a central axis of the tubular body 11 such that virtual faces extended from tilted faces 24 of the second outlets 16 intersect with each other in the passage 13 (See FIG. 3). If the tubular body 11 is cut vertically in a direction of wide sides, the pair of second outlets 16 is disposed in a shape of an inverted V.

In the immersion nozzle 10 according to the present embodiment, the first outlets 14 and the second outlets 16 communicate with each other through a slit 17 formed in the narrow sidewalls 18 and extending in the vertical direction.

[Water Model Tests]

In order to determine the optimum configurations of the first outlets 14 (the upper outlets 14*a*, the lower outlets 14*b*, and the partitioning sections 22), the second outlets 16, the ridges 15, and the slits 17, models of the immersion nozzle 10 having the above-described structures were produced and water model tests were performed. Hereinafter, descriptions will be given on the conducted water model tests.

Now, definitions of parameters are given for determining the optimum configurations of the first outlets 14 (the upper outlets 14*a*, the lower outlets 14*b*, and the partitioning sections 22), the second outlets 16, the ridges 15, and the slits 17.

Figure 2B:
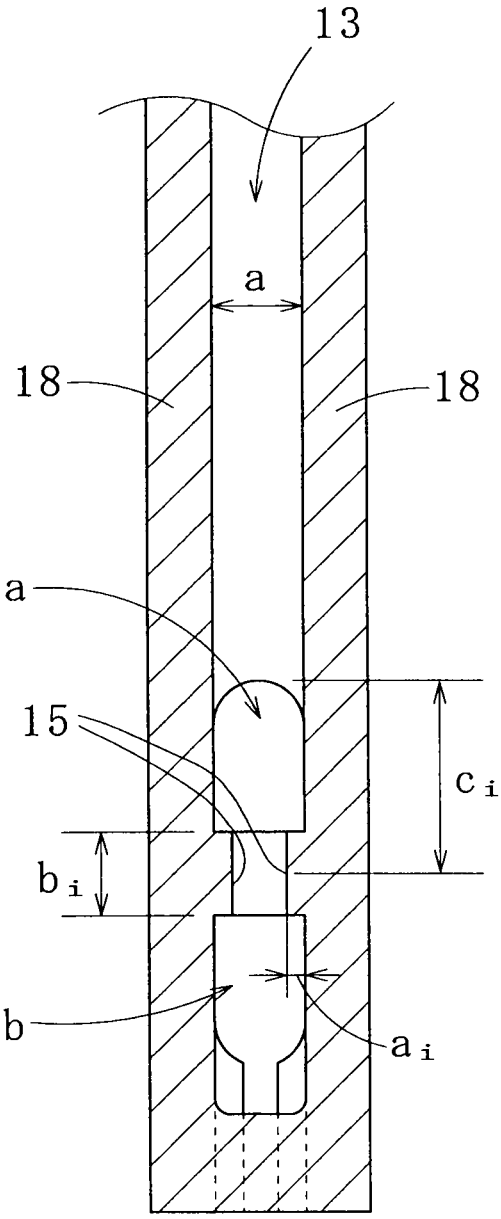
FIG. 2B is a partial vertical sectional view taken in a direction of narrow sides of the immersion nozzle for the continuous casting.

A horizontal width and a vertical length of each of the first outlets 14 are defined as a and b, respectively; a vertical width of each of the partitioning sections 22 is defined as be; a vertical distance from an upper end of each of the first outlets 14 to a vertical widthwise center of each of the partitioning sections 22 is defined as ce (See FIG. 2A); a projection height of each of the ridges 15 is defined as ai; a vertical width of each of the ridges 15 is defined as bi; and a vertical distance from the upper end position of each of the first outlets 14 to a vertical widthwise center of each of the ridges 15 is defined as ci (See FIG. 2B). In the water model tests, be=bi and ce=ci, and a horizontal-direction thickness of each of the partitioning sections 22 is equal to a thickness of each of the narrow sidewalls 18.

Figure 4A:
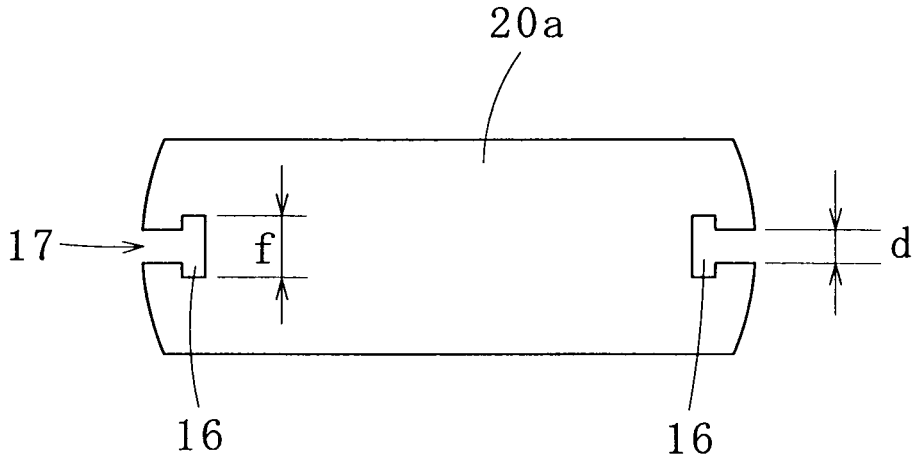
FIG. 4A is a lower end view of the immersion nozzle for the continuous casting.
Figure 4B:
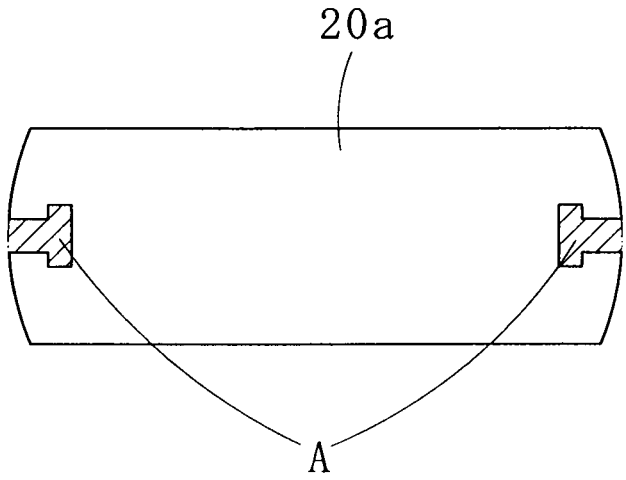
FIG. 4B is a lower end view of the immersion nozzle for the continuous casting, which clearly shows opening areas A of second outlets.

For the second outlets 16, an angle between a horizontal plane and a tilted face 24 of the second outlet 16 is defined as α, in which the tilted face 24 is formed at a bottom of the tubular body 11; the sum of opening areas of the second outlets 16 at a lower end face 20*a* of the tubular body 11 is defined as A (including opening areas of the slits 17 at the lower end face 20*a* of the tubular body 11); a horizontal cross sectional area of the passage 13 immediately above the first outlets 14 is defined as A'; the minimum internal dimension between the two second outlets 16 is defined as e; a width of each of the wide sides of the passage 13 immediately above the first outlets 14 is defined as e'; a width of each of the narrow sides of the passage 13 is defined as f (See FIG. 3, FIG. 4A, and FIG. 4B); and a width of each of the slits 17 is defined as d (See FIG. 4). In the water model tests, the width f of the narrow side of each of the second outlets 16 is equal to the width a of the narrow side (horizontal width) of each of the first outlets 14.

A 1/1 scale mold was made of an acrylic resin. In the mold, a length of the wide side was 1650 mm and a length of the narrow side was 90 mm. Water flowed (poured) from the immersion nozzle 10 to the mold was circulated by a pump.

The immersion nozzle 10 was placed in the center of the mold such that the wide sides of the rectangular flat cross section were parallel to the wide sides of the mold. The distance between the upper ends of the first outlets 14 and the water surface (molten steel surface) was 145 mm.

Figure 5:
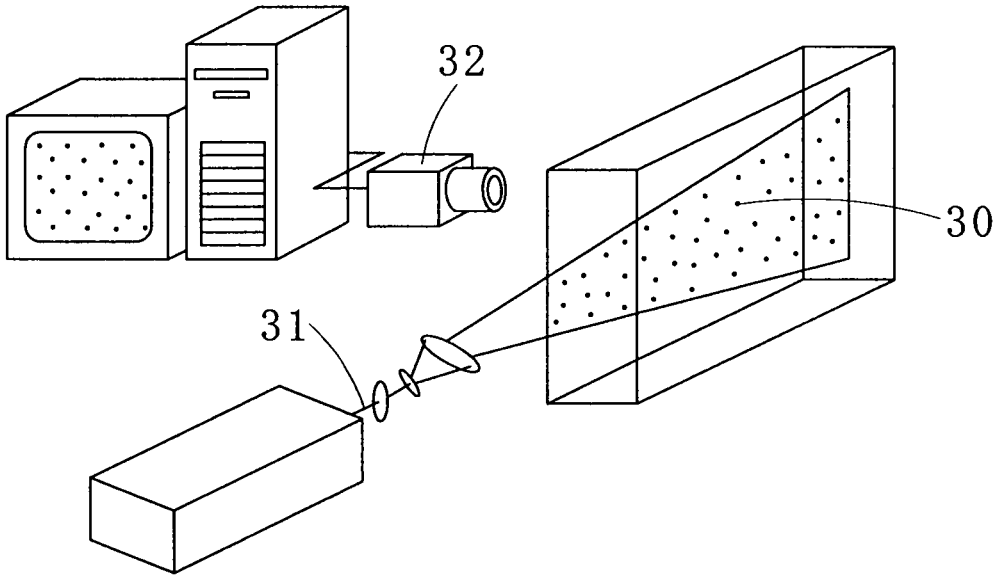
FIG. 5 is a schematic view for explaining particle image velocimetry.

In the water model tests, a velocity of exit-streams was calculated using Particle Image Velocimetry (PIV). In the PIV, particles called tracers 30 (of about 50 micrometers) were dispersed in the flow (See FIG. 5). And, images of the tracers 30 were taken with a camera 32 using a laser light lamp 31. Then, from two sequential images in a time series out of the obtained images, instantaneous and multipoint velocity information in a flow field was extracted.

By the PIV, the flows in the entire mold or at arbitrary positions can be visualized and quantified as vectors. Moreover, it is possible to analyze unsteady flows near the outlets of the immersion nozzle as continuous movements.

Hereinafter, descriptions will be given on results of the water model tests. All working examples and comparative examples except a comparative example 1 were performed using a tubular body (entire length: 985 mm, outside dimension of a bottom: 182 mm×46 mm), which includes a cylindrical upper section; a lower section with a rectangular flat cross section, the lower section having a bottom; and a tapered section connecting the cylindrical upper section and the lower section with the rectangular flat cross section. The comparative examples except the comparative example 1 were performed using the continuous casting immersion nozzle disclosed in Japanese Unexamined Patent Application Publication No. 2009-233717, i.e., the immersion nozzle having the first and second outlets, the ridges, and the slits but not having the partitioning sections. Basic specifications (excluding test items) of the above-described respective samples were as follows:

Ci=57.5 mm, bi=25 mm, b=115 mm, ai=5 mm, a=26 mm, e=26 mm, e'=143 mm, d=16 mm, α=24°, each radius of curvature of the upper and lower ends of the first outlet=13 mm, ci/b=0.5, bi/b=0.22, ai/a=0.19, A/A'=0.05, and d/a=0.62

On the other hand, the comparative example 1 were performed using a tubular body (entire length: 958 mm, outside shape of a bottom portion: 150 mm×46 mm), which includes a prismatic upper section; a lower section with a rectangular flat cross section, the lower section having a bottom; and a tapered section connecting the prismatic upper section and the lower section with the rectangular flat cross section. As the outlets, only a pair of elongated holes was formed respectively in narrow sidewalls of the lower section of the tubular body. Basic specifications of the comparative example 1 were as follows:

b=109 mm, a=25 mm, and e'=110 mm

When the double-roll flowing pattern is formed in the mold and the molten steel surface-flow velocity is in a certain range, flow velocities of upward and downward molten steel flows in the mold are controlled in a certain range. Thus, in the tests, the samples were evaluated based on formation of the double-roll flowing pattern and the molten steel surface-flow velocity. Specifically for the double-roll flowing pattern, √ indicates that the double-roll flowing pattern was formed, and X indicates that the double-roll flowing pattern was not formed. For the molten steel surface-flow velocity, √ indicates that an average value of the left and right molten steel surface-flow velocities, i.e., average molten steel surface-flow velocity $V_{av}$, was in a range of 0.2 to 0.55 m/sec, and X indicates that the average value was outside the range. If the average molten steel surface-flow velocity $V_{av}$ is lower than 0.2 m/sec, a molten mold powder layer becomes thin due to insufficient supply of heat to the molten steel surface, which may result in occurrence of breakout. On the other hand, if the average molten steel surface-flow velocity $V_{av}$ is higher than 0.55 m/sec, the molten mold powder layer becomes uneven due to molten steel surface fluctuation, which may similarly breakout or may lower the quality due to entrapment of the mold powder.

As results of simulations, water model tests, and various researches on association with operations, it was found out that a critical value of the average value (average molten steel surface-flow velocity $V_{av}$) of the left and right molten steel surface-flow velocities was 0.2 to 0.55 m/sec. The left and right molten steel surface-flow velocities each were a value at an intermediate position between the narrow side of the mold and the immersion nozzle, i.e., at a position of ¼ length of the wide side of the mold from the narrow side of the mold. The throughput was converted using the equation: specific gravity of molten steel/specific gravity of water=7.0.

Figure 6:
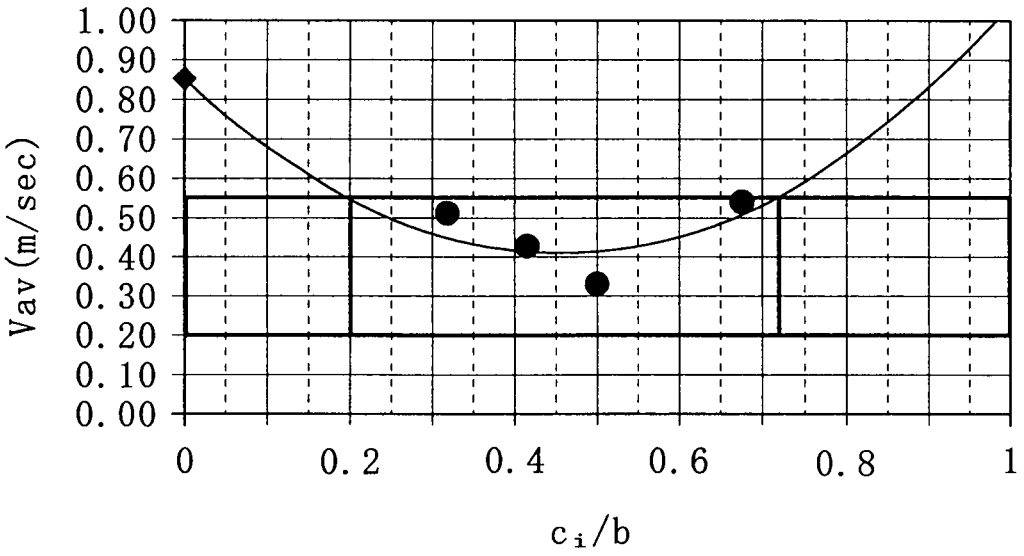
FIG. 6 shows a graph of the relationship between ci/b and an average molten steel surface-flow velocity $V_{av}$.

A correlation between ci/b and the average molten steel surface-flow velocity $V_{av}$, is shown in Table 1 and FIG. 6. These table and graph show that the average molten steel surface-flow velocity $V_{av}$ was in the range of 0.2 to 0.55 m/sec and the double-roll flowing pattern was formed when ci/b was in a range of 0.2 to 0.72. When ci/b was less than 0.2, flow-interrupting effect reduced and the exit-streams from the lower outlets increased, which increased a reverse flow velocity and the molten steel surface-flow velocity. On the other hand, when ci/b exceeded 0.72, the exit-streams from the upper outlets became dominant and the reverse flow velocity and the molten steel surface-flow velocity increased.

The above-described results show that the partitioning section is not limited to the central portion (ci/b=0.5) of each of the first outlets, and the lower outlets may be larger than the upper outlets, and vice versa. In the graphs to be mentioned hereinbelow, the sample represented by ♦ at zero on the abscissa indicates the comparative example 1 without the ridges.

TABLE 1

| Sample | ci/b | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 6 | 0.32 | 3.3 | 3.5 | 0.51 | 0.52 | 0.52 | ✓ | ✓ |
| Working Example 3 | 0.41 | 3.3 | 3.5 | 0.44 | 0.41 | 0.43 | ✓ | ✓ |
| Working Example 1 | 0.50 | 3.3 | 3.5 | 0.32 | 0.35 | 0.34 | ✓ | ✓ |
| Working Example 5 | 0.67 | 3.3 | 3.5 | 0.54 | 0.55 | 0.55 | ✓ | ✓ |
| Comparative example 1 | 0 | 3.3 | 3.5 | 0.86 | 0.83 | 0.85 | X | ✓ |

Figure 7:
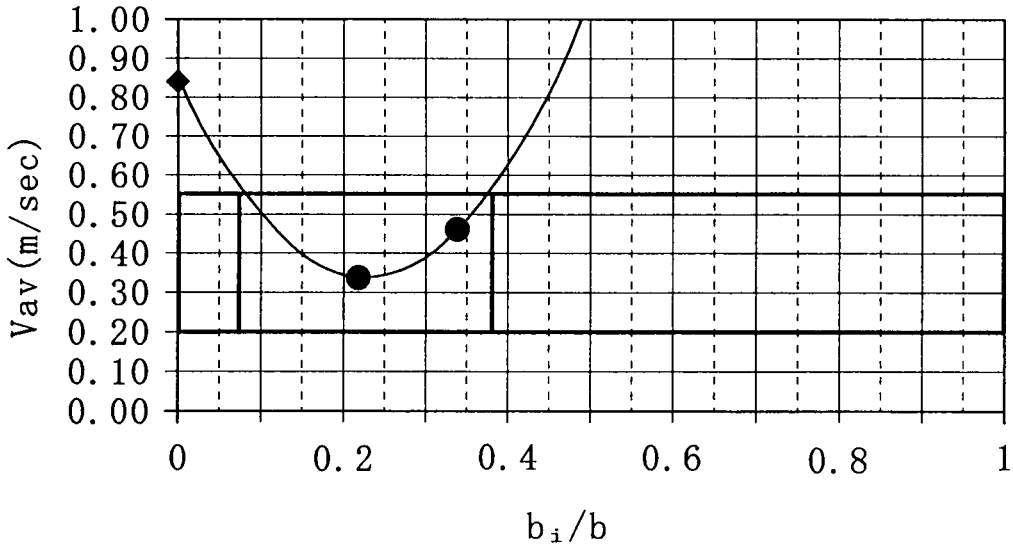
FIG. 7 shows a graph of the relationship between hi/b and the average molten steel surface-flow velocity $V_{av}$.

A correlation between bi/b and the average molten steel surface-flow velocity $V_{av}$ is shown in Table 2 and FIG. 7. These table and graph show that the average molten steel surface-flow velocity $V_{av}$ was in the range of 0.2 to 0.55 msec and the double-roll flowing pattern was formed when bi/b was in a range of 0.07 to 0.38. When bi/b was less than 0.07, the flow-interrupting effect reduced and the exit-streams from the lower outlets increased, which increased the reverse flow velocity and the molten steel surface-flow velocity. On the other hand, when bi/b exceeded 0.38, cross sectional areas of the first outlets became extremely small, which drastically increased the exit-stream velocities.

TABLE 2

| Sample | bi/b | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 1 | 0.22 | 3.3 | 3.5 | 0.32 | 0.35 | 0.34 | ✓ | ✓ |

TABLE 2-continued

| Sample | bi/b | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 7 | 0.34 | 3.3 | 3.5 | 0.46 | 0.45 | 0.46 | ✓ | ✓ |
| Comparative example 1 | 0 | 3.3 | 3.5 | 0.86 | 0.83 | 0.85 | X | ✓ |

Figure 8:
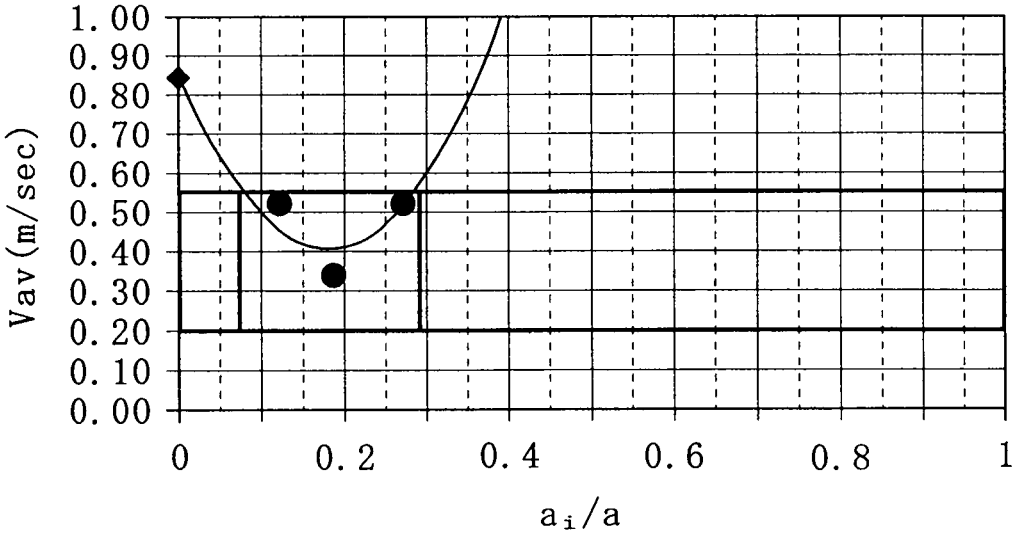
FIG. 8 shows a graph of the relationship between ai/a and the average molten steel surface-flow velocity $V_{av}$.

A correlation between ai/a and the average molten steel surface-flow velocity $V_{av}$ is shown in FIG. 8 and Table 3. These graph and table show that the average molten steel surface-flow velocity $V_{av}$ was in the range of 0.2 to 0.55 msec and the double-roll flowing pattern was formed when ai/a was in a range of 0.07 to 0.28. When ai/a was less than 0.07, flow-interrupting effect reduced and the exit-streams from the lower outlets increased, which increased a reverse flow velocity and the molten steel surface-flow velocity. On the other hand, in case that ai/a exceeded 0.28, flows to the lower outlets extremely reduced, which made the exit-streams from the upper outlets dominant, and increased the reverse flow velocity and the molten steel surface-flow velocity.

TABLE 3

| Sample | ai/a | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 8 | 0.12 | 3.3 | 3.5 | 0.51 | 0.53 | 0.52 | ✓ | ✓ |
| Working Example 1 | 0.19 | 3.3 | 3.5 | 0.32 | 0.35 | 0.34 | ✓ | ✓ |
| Working Example 9 | 0.27 | 3.3 | 3.5 | 0.54 | 0.53 | 0.54 | ✓ | ✓ |
| Comparative example 1 | 0 | 3.3 | 3.5 | 0.86 | 0.83 | 0.85 | X | ✓ |

Figure 9:
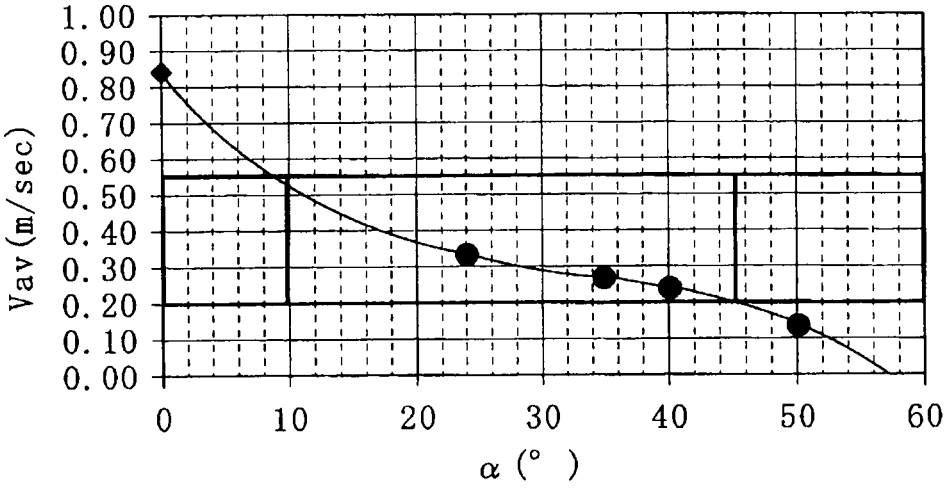
FIG. 9 shows a graph of the relationship between an angle $\alpha$ of tilted faces of the second outlets and the average molten steel surface-flow velocity $V_{av}$.

A correlation between the angle α of the tilted face of each of the second outlets and the average molten steel surface-flow velocity $V_{av}$ is shown in Table 4 and FIG. 9. These table and graph show that the average molten steel surface-flow velocity $V_{av}$ was in the range of 0.2 to 0.55 msec and the double-roll flowing pattern was formed when the angle α of the tilted face was in a range of 10° to 45°. When the angle α of the tilted face is outside 10° to 45°, the double-roll flowing pattern may not be formed in some cases.

TABLE 4

| Sample | α | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 1 | 24 | 3.3 | 3.5 | 0.32 | 0.35 | 0.34 | ✓ | ✓ |
| Comparative example 1 | 0 | 3.3 | 3.5 | 0.86 | 0.83 | 0.85 | X | ✓ |
| Comparative example 2 | 35 | 2.7 | 2.9 | 0.29 | 0.26 | 0.28 | ✓ | ✓ |
| Comparative example 3 | 40 | 2.7 | 2.9 | 0.23 | 0.25 | 0.24 | ✓ | ✓ |
| Comparative example 4 | 50 | 2.7 | 2.9 | 0.13 | 0.15 | 0.14 | X | X |

Figure 10:
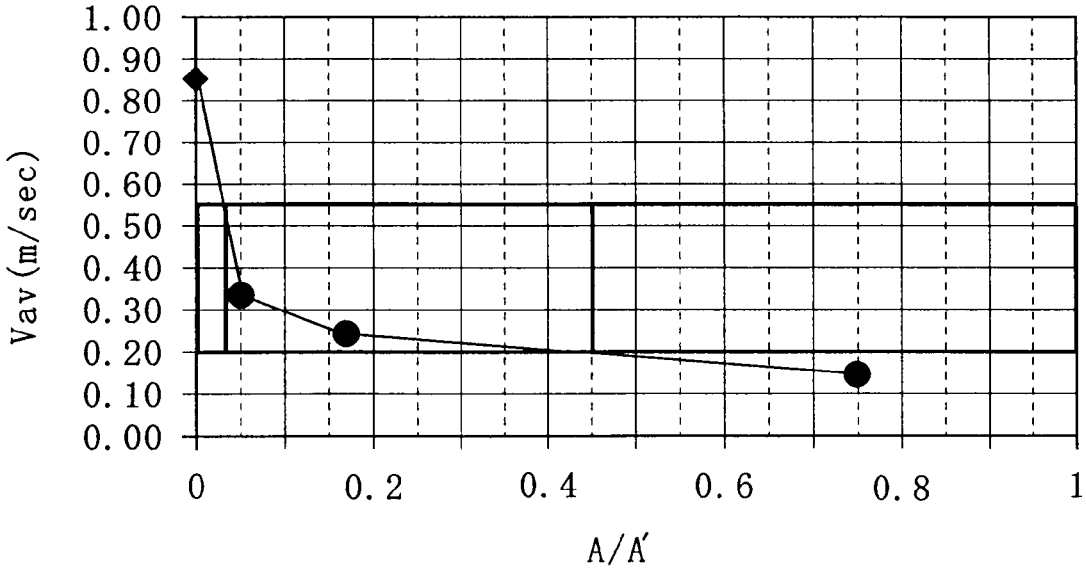
FIG. 10 shows a graph of the relationship between A/A' and the average molten steel surface-flow velocity $V_{av}$.

A correlation between A/A' and the average molten steel surface-flow velocity $V_{av}$ is shown in Table 5 and FIG. 10. These table and graph show that the average molten steel surface-flow velocity $V_{av}$ was in the range of 0.2 to 0.55 msec and the double-roll flowing pattern was formed when A/A' was in a range of 0.03 to 0.45. When A/A' was less than 0.03, the exit-stream velocity from each of the first outlets became excessively high and the average molten steel surface-flow velocity $V_{av}$ exceeded 0.55 msec. On the other hand, when A/A' exceeded 0.45, the exit-streams from the second outlets became dominant and the reverse flow became less likely to be formed. As a result, the double-roll flowing pattern was not formed and the average molten steel surface-flow velocity $V_{av}$ became lower than 0.2 m/sec.

TABLE 5

| Sample | A/A' | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 1 | 0.05 | 3.3 | 3.5 | 0.32 | 0.35 | 0.34 | ✓ | ✓ |
| Comparative example 1 | 0 | 3.3 | 3.5 | 0.86 | 0.83 | 0.85 | X | ✓ |
| Comparative example 3 | 0.17 | 2.7 | 2.9 | 0.23 | 0.25 | 0.24 | ✓ | ✓ |
| Comparative example 4 | 0.8 | 2.7 | 2.9 | 0.13 | 0.15 | 0.14 | X | X |

Figure 11:
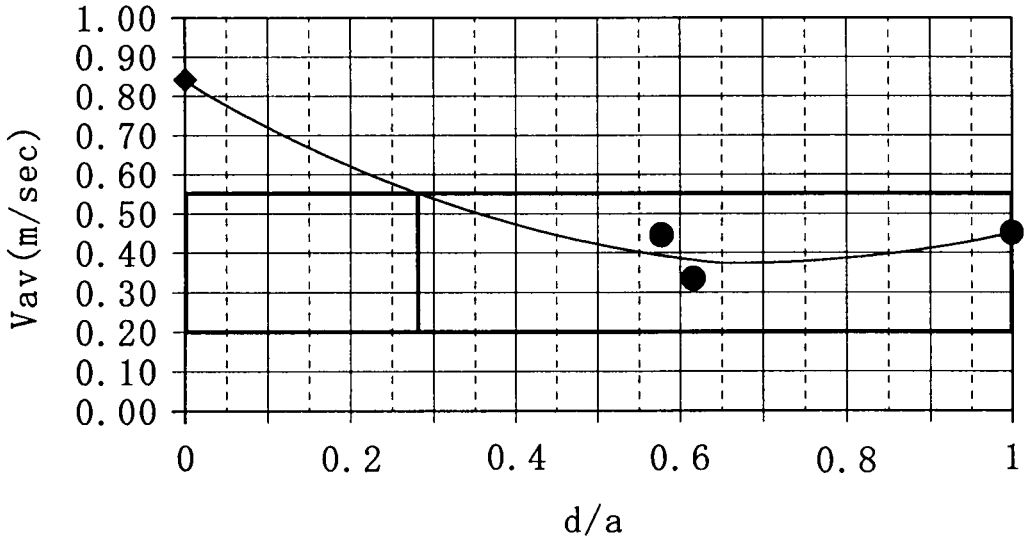
FIG. 11 shows a graph of the relationship between d/a and the average molten steel surface-flow velocity $V_{av}$.

A correlation between d/a and the average molten steel surface-flow velocity $V_{av}$ is shown in Table 6 and FIG. 11. These table and graph show that the average molten steel surface-flow velocity $V_{av}$ was in the range of 0.2 to 0.55 msec and the double-roll flowing pattern was formed when d/a was in a range of 0.28 to 1.0. When d/a was less than 0.28, the flow-interrupting effect reduced and the exit-streams from the lower outlets increased, which increased the reverse flow velocity and the molten steel surface-flow velocity. The maximum value of d/a was 1.0 because the slit width d could not be greater than the width a of the first outlets.

TABLE 6

| Sample | d/a | Pouring rate (m/min) | Throughput (ton/min) | Surface-flow velocity(m/sec) Left | Right | Average | Evaluation Surface-flow velocity | Double roll |
|---|---|---|---|---|---|---|---|---|
| Working Example 1 | 0.62 | 3.3 | 3.5 | 0.32 | 0.35 | 0.34 | ✓ | ✓ |
| Working Example 4 | 0.58 | 3.3 | 3.5 | 0.44 | 0.45 | 0.45 | ✓ | ✓ |
| Working Example 2 | 1.00 | 3.3 | 3.5 | 0.45 | 0.47 | 0.46 | ✓ | ✓ |
| Comparative example 1 | 0 | 3.3 | 3.5 | 0.86 | 0.83 | 0.85 | X | ✓ |

Figure 12:
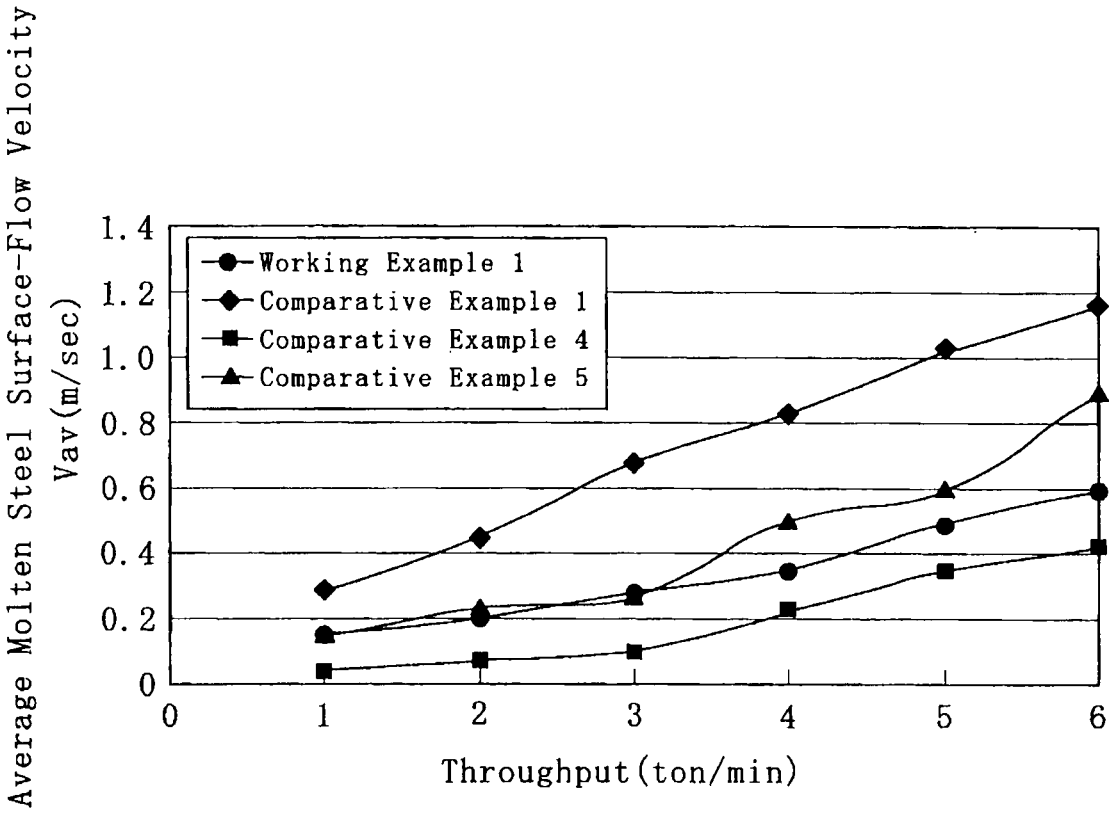
FIG. 12 shows a graph of the relationship between the average molten steel surface-flow velocity and throughput.
Figure 13:
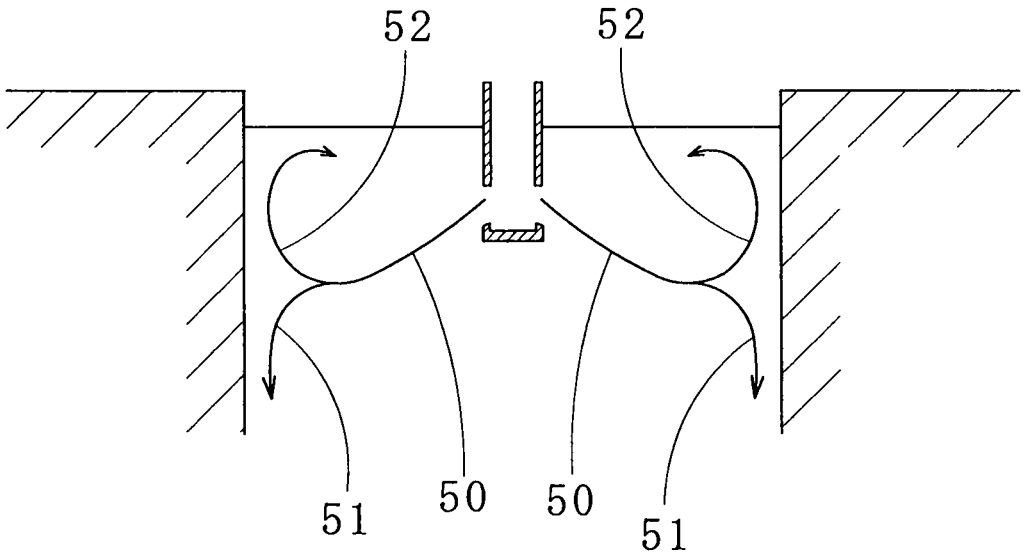
FIG. 13 is a schematic view for explaining a double-roll flowing pattern.

FIG. 12 shows a correlation between the average molten steel surface-flow velocity $V_{av}$ and the throughput. This figure shows that the average molten steel surface-flow velocity $V_{av}$ increases as the throughput increases. Among the samples, the comparative example 1 had the highest average molten steel surface-flow velocity $V_{av}$. In the comparative example 1, when the throughput exceeded 2.5 ton/min, the average molten steel surface-flow velocity $V_{av}$ exceeded 0.55 m/sec, which is the upper limit value of the optimum value. In the comparative example 4, when the throughput was lower than or equal to 4 ton/min, the average molten steel surface-flow velocity $V_{av}$ was less than 0.2 m/sec, which is the lower limit value of the optimum value. On the other hand, in the working example 1, when the throughput was in a range of 2 to 5.5 ton/min, the average molten steel surface-flow velocity $V_{av}$ was in the range of the optimum value. The comparative example 5 has substantially the same tendency as the working example 1. However, when the throughput exceeded 0.48 ton/min, the average molten steel surface-flow velocity $V_{av}$ exceeded 0.55 m/sec, which is the upper limit value of the optimum value.

While the preferred embodiment of the invention has been described and illustrated above, it should be understood that this is exemplary of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims. For example, although be=bi and ce=ci in the water model tests, these relationships may be as follows: be≠bi and/or ce≠ci. Although the slits connecting the first outlets and the second outlets were provided in the water model tests, the slits may not be provided.

What is claimed is:

1. An immersion nozzle for continuous casting, comprising:

a tubular body elongated along a central axis, the tubular body having a bottom in the direction of elongation of the tubular body, the bottom of the elongated tubular body having a lower end face extending generally transverse to the direction of elongation of the tubular body, the tubular body having an inlet for entry of molten steel disposed at an upper end of the tubular body in the direction of elongation of the tubular body, a passage extending inside the tubular body downward from the inlet toward the bottom, wherein at least a lower section of the tubular body and the passage have a rectangular flat shape in a cross section transverse to the direction of elongation of the tubular body, the rectangular flat shape of the passage being defined by relatively narrow opposite inner sidewalls of the rectangular flat shape of the tubular body and relatively wide opposite inner sidewalls of the rectangular flat shape of the tubular body;

a pair of opposing first outlets disposed in the narrow sidewalls forming the passage so as to communicate with the passage, a pair of second outlets disposed in the lower end face of the tubular body so as to communicate with the passage;

a pair of partitioning sections respectively formed in the relatively narrow sidewalls at the pair of the first outlets, each of the partitioning sections partitioning a respective first outlet into an upper outlet and a lower outlet, which upper outlet and lower outlet are separated from one another by the respective partitioning section; and ridges formed between the pair of partitioning sections, each of the ridges projecting into the passage from one of the relatively wide opposite inner sidewalls forming the rectangular shape of the passage, and horizontally intersecting the respective relatively wide inner sidewall;

wherein the pair of second outlets are disposed symmetrically to the central axis of the tubular body such that virtual faces extended from tilted faces of the second outlets intersect with each other in the passage.

2. The immersion nozzle for continuous casting of claim 1, further comprising slits in the narrow sidewalls to connect the first outlets and the second outlets.

3. The immersion nozzle for continuous casting of claim 1, wherein be=bi, and ce=ci, wherein be is a vertical width of the partitioning section; ce is a vertical distance between an upper end of the first outlet and a vertical widthwise center of the partitioning section; bi is a vertical width of the ridge; and ci is a vertical distance between the upper end of the first outlet and a vertical widthwise center of the ridge.

4. The immersion nozzle for continuous casting of claim 3, wherein ci/b ranges from 0.2 to 0.72, ai/a ranges from 0.07 to 0.28, and bi/b ranges from 0.07 to 0.38, given that a is a horizontal width of the first outlet; b is a vertical length of the first outlet; and ai is a projection height of the ridge.

5. The immersion nozzle for continuous casting of claim 4, wherein $\alpha$ ranges from 10 to 45° and A/A' ranges from 0.03 to 0.45, given that a is an angle between a horizontal plane and a tilted face of the second outlet, the tilted face formed at a bottom of the tubular body; A is the sum of opening areas of the second outlets at the lower end face of the tubular body; and A' is a horizontal cross sectional area of the passage immediately above the first outlets.

6. The immersion nozzle for continuous casting of claim 2, wherein be=bi, and ce=ci, wherein be is a vertical width of the partitioning section; ce is a vertical distance between an upper end of the first outlet and a vertical widthwise center of the partitioning section; bi is a vertical width of the ridge; and ci is a vertical distance between the upper end of the first outlet and a vertical widthwise center of the ridge.

7. The immersion nozzle for continuous casting of claim 6, wherein ci/b ranges from 0.2 to 0.72, ai/a ranges from 0.07 to 0.28, and bi/b ranges from 0.07 to 0.38, given that a is a horizontal width of the first outlet; b is a vertical length of the first outlet; and ai is a projection height of the ridge.

8. The immersion nozzle for continuous casting of claim 7, wherein $\alpha$ ranges from 10 to 45° and A/A' ranges from 0.03 to 0.45, given that $\alpha$ is an angle between a horizontal plane and a tilted face of the second outlet, the tilted face formed at the bottom of the tubular body; A is the sum of opening areas of the second outlets at a lower end face of the tubular body; and A' is a horizontal cross sectional area of the passage immediately above the first outlets.

9. The immersion nozzle for continuous casting of claim 7, wherein d/a ranges from 0.28 to 1.0, given that d is a width of the slit.

10. The immersion nozzle for continuous casting of claim 8, wherein d/a ranges from 0.28 to 1.0, given that d is a width of the slit.

* * * * *